United States Patent [19]

Kellogg et al.

[11] Patent Number: 4,617,546

[45] Date of Patent: Oct. 14, 1986

[54] ELECTRICAL CONTROL APPARATUS WITH ELECTROMAGNETIC LATCH

[75] Inventors: Walter J. Kellogg, Black Mountain; Birch L. DeVault, Arden; Kenneth L. Paape, Asheville, all of N.C.

[73] Assignee: Westinghouse Electric Corp., Pittsburgh, Pa.

[21] Appl. No.: 657,924

[22] Filed: Oct. 5, 1984

[51] Int. Cl.[4] ..... H01H 9/20

[52] U.S. Cl. ..... 337/170; 337/179; 337/229

[58] Field of Search ..... 335/132, 131, 170, 229, 335/230, 234, 179

[56] References Cited

U.S. PATENT DOCUMENTS

| | | | |
|---|---|---|---|
| 3,371,297 | 2/1968 | Ridings | 335/234 |
| 3,821,671 | 6/1974 | Grunert et al. | 335/132 |
| 4,164,721 | 8/1979 | Ishida et al. | 335/229 |
| 4,240,055 | 12/1980 | Shimizu et al. | 335/229 |

*Primary Examiner*—Harold Broome

*Attorney, Agent, or Firm*—L. P. Johns

[57] ABSTRACT

An electrical control apparatus characterized by a pair of separable contacts with electromagnetic means for opening and closing the contacts and including a U-shaped core having spaced legs and a yoke, a permanent magnet across the yoke, and the magnet having a cross-section greater than that of either leg.

3 Claims, 8 Drawing Figures

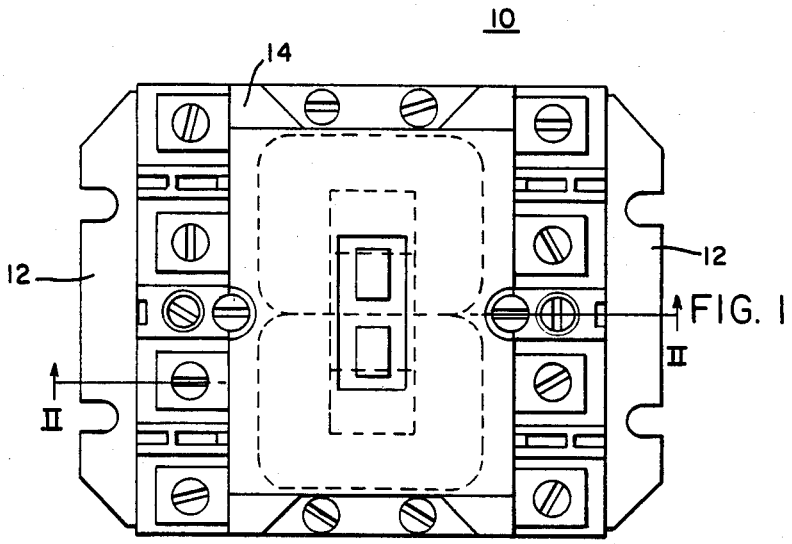
FIG. 1
FIG. 2
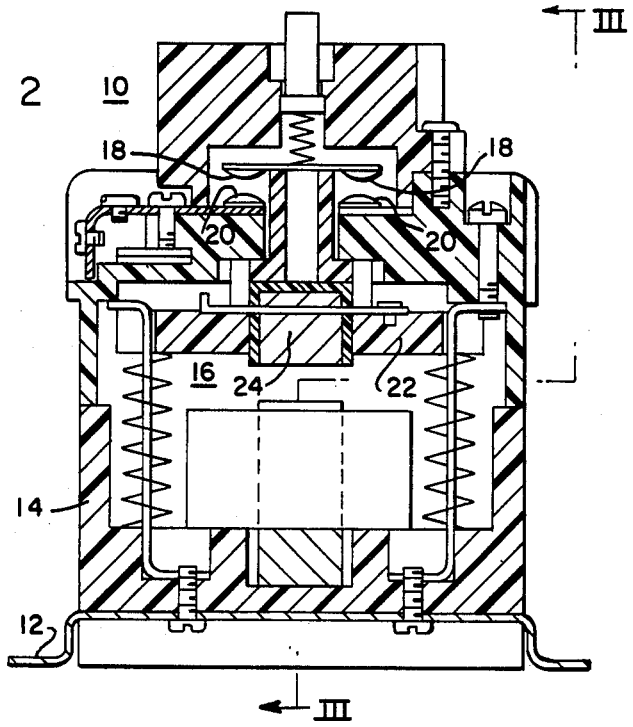

ELECTRICAL CONTROL APPARATUS WITH ELECTROMAGNETIC LATCH

BACKGROUND OF THE INVENTION

1. Field of the Invention

This invention relates to an electromagnetic control device and more particularly it pertains to a permanent magnet associated therewith.

2. Description of the Prior Art

Industrial equipment that is operated electrically, such as by a motor or industrial lighting, is usually regulated by a control device which may be a contactor or relay having parts movable between two positions for opening and closing a circuit through the motor. It is often desirable with such equipment to latch or hold the control device in an energized or "on" position for long periods of time. In the past, it has been the practice to use either a mechanical latch to jam a solenoid armature in the energized position or a permanent magnet inserted in the magnetic circuit so that upon being energized, the device remains in that position after interruption of power or until a reversal signal is applied. Moreover, a disadvantage of prior mechanical latch mechanisms has been the fact that once the coil of the solenoid is deenergized, the solenoid armature drops back a small distance until blocked by the mechanical latch. With permanent magnets of prior usage in order to obtain enough magnetic "pull" cobalt alloy magnets, such as Alnico, have been used. However, cobalt alloys are undesirable because of the uncertainty of their availability in the future and their increasing cost.

SUMMARY OF THE INVENTION

In accordance with this invention, there is provided an electric control apparatus comprising an insulating housing, pairs of separable contacts within the housing, means within the housing for moving the contacts between open and closed positions and comprising an electromagnetic control mechanism including a magnetic armature, a U-shaped core, and a coil, the core including spaced legs and a yoke, and a permanent magnet extending across and through the cross-section of the yoke with corresponding interfaces and with the yoke cross-section being at least equally coextensive with that of the yoke, the magnet having a cross-sectional area greater than that of either leg, and the magnet consisting of a ceramic-base material.

The advantage of the device of this invention is that a permanent magnet takes the place of a mechanical latch to save energy and reduce hum by deenergizing the coil whereby the magnet holds the unit in a fully operated position.

BRIEF DESCRIPTION OF THE DRAWINGS

FIG. 1 is a plan view of an electric control device constructed in accordance with the principles of this invention;

FIG. 2 is a vertical sectional view taken on the line II—II of FIG. 1;

DESCRIPTION OF THE PREFERRED EMBODIMENTS

Figure 3:
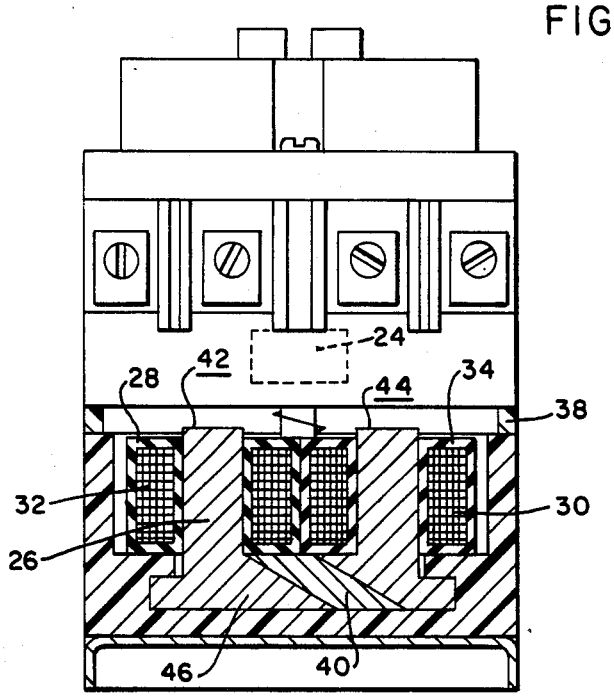
FIG. 3 is a vertical sectional view taken along the line III—III of FIG. 2.

In the drawings, an electric control device or contactor is generally indicated at 10. Inasmuch as the contactor is more specifically described in U.S. Pat. No. 3,821,671, issued June 8, 1974, the description herein is limited generally to the operating parts that are pertinent to the invention.

Generally, the contactor 10 comprises a base plate 12, a housing 14 composed of electrically insulating material, and an operating structure generally indicated at 16 (FIG. 2). The contactor 10 is a multi-pole control device of which only one set of poles is shown in FIG. 2 and includes similar movable contacts 18 and stationary contacts 20. The contactor 10, being operated by an electromagnetic actuator, includes a molded insulating contact carrier 22 and a generally U-shaped magnetic armature 24.

The electromagnetic actuator also includes a generally U-shaped magnetic core 26 (FIG. 3) and a coil structure 28. The coil structure comprises a pair of coil windings 30, 32 which are wound on separate spools or bobbins 34, 36, respectively. The assemblies of the windings 30, 32 and bobbins 34, 36 are preferably encapsulated in a molded portion 38 of the housing 14 which is composed of a thermosetting resinous material such as a glass polyester resin.

In accordance with this invention, a permanent magnet 40 is combined with the core 26 to provide enough magnetic force to hold the armature 24 (FIG. 3) in contact with legs 42, 44 which extend upwardly from a yoke 46 of the core. The magnet 40 is disposed at an angle, preferably 30°, to the longitudinal axis of the yoke and is shown more particularly in FIG. 4. The magnet force available from the magnet 40 is proportional to the area of the permanent magnet face in the magnetic circuit. Hence, the maximum face area in the circuit is obtained by placing the magnet diagonally within the yoke 46 as shown in FIGS. 3, 4.

Figure 4:
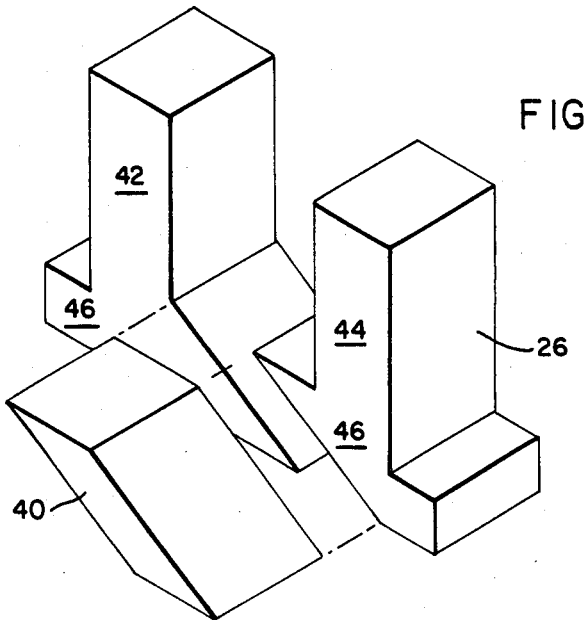
FIG. 4 is an exploded isometric view of one embodiment of the invention.
Figure 5:
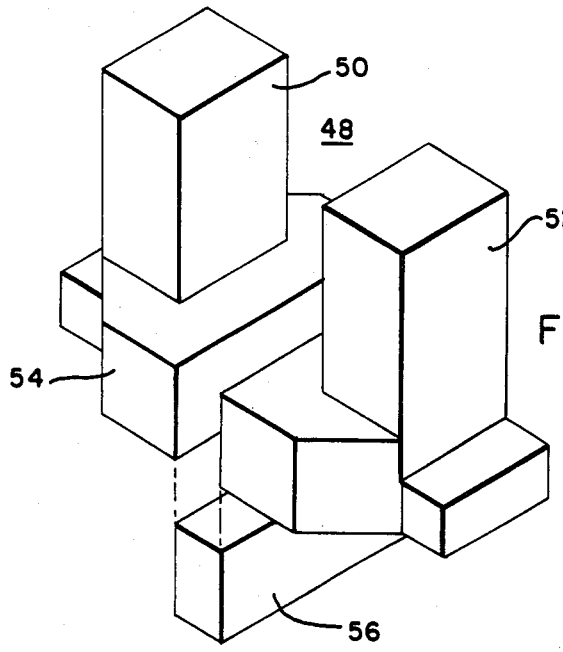
FIG. 5 is an isometric view of another embodiment of the invention.

Another embodiment of the invention is shown in FIG. 5 wherein a core 48 having legs 50, 52 and a yoke 54 includes a permanent magnet 56 which is disposed perpendicular to the longitudinal axis of the yoke, rather than at an angle thereto as disclosed in FIG. 4. Like the embodiment of FIG. 4, the embodiment of FIG. 5 gives a maximum face area in the magnetic circuit, but is accomplished by enlarging the cross-section of the yoke 54 where the magnet is inserted. To obtain the maximum face area in the magnetic circuit, the cross-sectional area of the magnet is greater than that of either leg of the cores involved in either embodiment.

Figure 6:
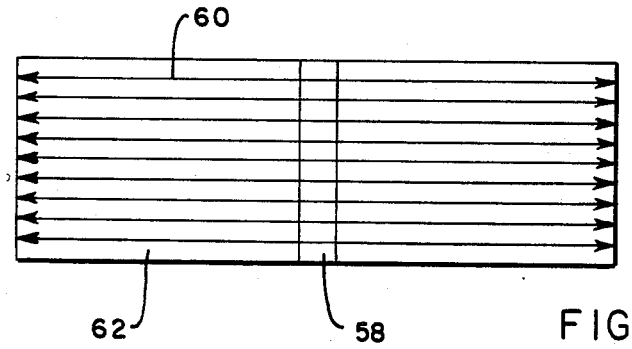
FIG. 6 PRIOR ART
FIG. 6 is a diagrammatic view of a prior art magnet assembly with an Alnico magnet.
Figure 7:
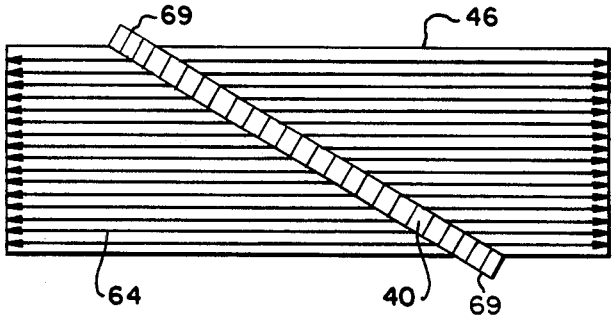
FIG. 7 is a diagrammatic view of a ceramic magnet disposed at a 30° angle to the axis of the magnet assembly corresponding to that shown in FIG. 4.

As shown in the prior art structure of FIG. 6, a permanent Alnico magnet 58 is disposed perpendicular to the longitudinal axis or magnetic force lines 60 in a yoke 62. The magnetic force of the circuit passing through the yoke 62 is shown diagrammatically by the number of spaced force lines 60 and is directly dependent upon the permanent magnet length in the circuit of the magnet 58. On the other hand, for ceramic magnets the magnetic force available is proportional to the face area and is greater where, as shown in FIG. 7, the magnet 40 is disposed at an angle to the magnetic force lines 64 extending through the yoke 46, the force being indicated by the greater number of lines 64 than the number of lines 60 in FIG. 6. Thus, by disposing the magnet 40 at an angle, a maximum face area exists between the interfaces of the magnet and the yoke 64. By disposing the magnet 40 at an angle of 30°, a longer magnet with larger opposite sides is used.

Figure 8:
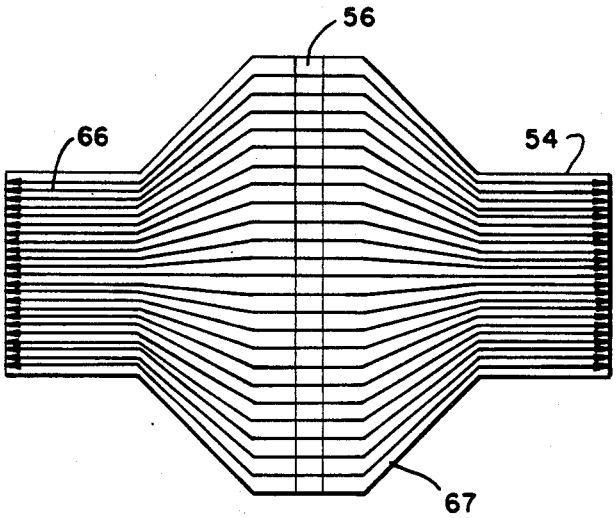
FIG. 8 is a diagrammatic view of a magnet disposed perpendicularly to the longitudinal axis of the core corresponding to the FIG. 5.

In FIG. 8, the magnet 56 is disposed perpendicularly or normal to the lines of force 66 in the yoke 54 to obtain the maximum magnetic force in the core circuit. The yoke 54 includes an enlarged portion 67. In this manner, the magnet 56 having a dimension comparable to that of the magnet 40 provides the same magnetic density through the magnet as shown in FIG. 6. However, the larger dimension of the magnet 56 provides for a higher magnetic force. The advantage of the embodiment of FIG. 7 is that the magnet 56 of the same dimension as yoke 62 (FIG. 6) may be used to replace the latter yoke. Where space requirements require it, the 90° corners 69 may be eliminated. Where, however, space in a contactor housing is sufficient, the embodiment of FIG. 8 having the enlarged portion 67 is preferably used.

Both magnets 40, 56 are ceramic magnets and composed of a material called "Ceramic 8". The material is available in the market place. For example, some ceramic magnets, such as Indox magnets, have a chemical composition of $MO.Fe_2O_3$, where M represents barium, strontium, lead, or combinations thereof. They are formed by compacting and sintering, are hard and brittle, and can be ground, usually with diamond wheels, to obtain desired tolerances. They are characterized by high coercive force which makes practical much shorter magnetic lengths than are possible with Alnico, but with increases in magnet and due to lower induction. Indox magnets require magnetizing fields of 10,000 oersteds. Magnetic properties are poor in other than the direction of full orientation. The assemblies of both embodiments are held together by suitable means, such as wrapping the yokes in tape or encapsulating them in a suitable insulating epoxy material which is not shown. For both embodiments AC or DC current may be used. For example, one-half wave pulsating DC is used to energize the coil and reverse the polarity to deenergize the coil. A late braking normally closed and normally open auxiliary interlock is used to disengage the coil from the power source.

In conclusion, the device of this invention saves energy and reduces any hum which otherwise accompanies solenoid operated devices having mechanical latches. The device of this invention provides a permanent magnet that replaces the mechanical latch. Its advantage is that it holds the unit in full operated position and saves energy by deenergizing the coil. To subsequently release the armature from the core, the current to the coil is reversed.

What is claimed is:

1. An electric control apparatus comprising:

(a) an insulating housing;

(b) pairs of separable contacts within the housing;

(c) means within the housing for moving the contacts between open and closed positions and comprising an electromagnetic control mechanism including a magnetic armature, a U-shaped core, and a coil;

(d) the magnetic U-shaped core including spaced legs and a yoke;

(e) a permanent magnet within the yoke extending across and through the cross-section of the yoke and having corresponding abutting interfaces;

(f) the magnet being inclined at an acute angle to the longitudinal axis of the yoke and the interfaces having a greater area than the cross-sectional area of a plane extending perpendicular to the longitudinal axis of the yoke; and (g) the magnet consisting of a ceramic base material.

2. The apparatus of claim 1 in which the magnet includes a barium base material.

3. The apparatus of claim 1 in which the magnet is disposed at an acute angle of 30°.

* * * * *